US007341167B2

(12) United States Patent
Mochiachvili et al.

(10) Patent No.: US 7,341,167 B2
(45) Date of Patent: Mar. 11, 2008

(54) ILLUMINATING POURING SPOUT

(76) Inventors: Michael Mochiachvili, Technetron, 36 E. 29h St., New York, NY (US) 10016; Dennis Glenn, Technetron, 36 E. 29th St., New York, NY (US) 10016

( * ) Notice: Subject to any disclaimer, the term of this patent is extended or adjusted under 35 U.S.C. 154(b) by 454 days.

(21) Appl. No.: 11/042,882

(22) Filed: Jan. 25, 2005

(65) Prior Publication Data

US 2005/0167445 A1 Aug. 4, 2005

Related U.S. Application Data

(60) Provisional application No. 60/539,265, filed on Jan. 27, 2004.

(51) Int. Cl.
*B65D 5/66* (2006.01)

(52) U.S. Cl. ..... 222/113; 362/101

(58) Field of Classification Search ..... 222/113, 222/13, 641, 566, 1, 192; 362/101, 161, 362/154, 155, 204
See application file for complete search history.

(56) References Cited

U.S. PATENT DOCUMENTS 2,477,984 A * 8/1949 Jackson ..... 222/78
2,547,450 A * 4/1951 Du Pont ..... 222/113
4,938,384 A * 7/1990 Pilolla et al. ..... 222/52
5,507,411 A * 4/1996 Peckels ..... 222/1
6,174,066 B1 * 1/2001 Vinding-Diers ..... 362/96
6,409,046 B1 * 6/2002 Peckels ..... 222/1
6,758,308 B1 * 7/2004 Hearting et al. ..... 184/105.1
7,028,864 B2 * 4/2006 McCann et al. ..... 222/144.5
7,189,134 B2 * 3/2007 Nugent et al. ..... 446/74
2001/0050289 A1 * 12/2001 Cordes ..... 222/39

* cited by examiner

*Primary Examiner*—Lien M. Ngo
(74) *Attorney, Agent, or Firm*—Charles E. Temko

(57) ABSTRACT

The Illuminating Pouring Spout is a new and improved pouring spout for use and attachment on an open end of a liquid container. The pouring spout bears elastically against the inner wall of the liquid container to hold it in place. The pouring spout contains a power source and a light source in a chamber within the pouring spout. The power source and light source are connected in such a way that when the liquid container is moved, grasped or inverted for pouring the Illuminating Pouring Spout is engaged until it is released or still. The light source may be aimed down into the liquid container and/or aimed outward from the dispensing end of the pouring spout. When engaged, the Illuminating Pouring Spout's visual effects are pleasing to the eyes of nearby observers and are useful for advertising and attracting business.

1 Claim, 6 Drawing Sheets

ILLUMINATING POURING SPOUT

CROSS REFERENCE TO RELATED APPLICATIONS

We claim benefit to an earlier filed provisional application, No. 60/539,265, filed on Jan. 27, 2004 pursuant to 35 U.S.C. 119(e).

BACKGROUND OF THE INVENTION

1. Field of the Invention

The present invention relates to a novelty item in the form of a pouring spout that attaches to an open end of a liquid container and has an illumination device enclosed in a cavity within the pouring spout. The invention is intended to be used for dispensing liquids from liquid containers in a visually pleasing and attractive way. The illumination device can be constructed so that it illuminates the liquid container, any liquid within the container, a portion of dispensed liquid exiting the spout, or any combination thereof. The pouring spout is useful as a promotional novelty item for a business or product. It is also useful for personal enjoyment and the visual effect is pleasing to observers.

2. Description of the Related Art

Pouring spouts are well known in the art. U.S. Pat. Nos. 6,227,419; 4,427,138; and 4,834,151 teach efficient ways for pouring spouts to dispense liquid and attach to liquid containers, namely glass liquor bottles. Illuminating promotional items are known in the art, combinations of pouring spouts and illuminating promotional items are also known in the art. However, these combinations are limited because they only illuminate the outside of the pouring spout and, therefore, they do not provide the benefits of the present invention. For example, liquor companies, such as Captain Morgan's and Crown Royal, have introduced novelty pouring spouts with small external lights to promote their brand in the marketplace. The present invention is a novel improvement in the art whereby the pouring spout contains an internal illumination device that illuminates the liquid container, any liquid within the container, a portion of dispensed liquid exiting the pouring spout, or any combination thereof.

BRIEF SUMMARY OF THE INVENTION

This invention relates to a liquid dispensing pouring spout that illuminates the liquid container, any liquid within the container, a portion of dispensed liquid, or any combination thereof. The present invention is a device that attaches to the open end of a liquid container and can be utilized to create a variety of attractive and desirable visual effects.

Grasp-Engaging Electrical Switch Embodiments

One embodiment of the present invention is to have a pouring spout that illuminates the liquid contained within the container and the container itself when the container is grasped and a switch parallel to the outer wall of the container is engaged. Another embodiment of the present invention is to have a pouring spout that illuminates a portion of the liquid as it exits the container through the pouring spout when the container is grasped and a switch parallel to the outer wall of the container is engaged. Yet another embodiment of the present invention is to have a pouring spout that simultaneously illuminates the liquid contained within the container, the container itself, and a portion of the dispensed liquid as it exits the container through the pouring spout when the container is grasped and a switch parallel to the outer wall of the container is engaged.

Automatic Electrical Switch Embodiments

A further embodiment of the present invention is to have a pouring spout that illuminates the liquid contained within the container and the container itself when the container is moved or inverted and an automatic switch within the pouring spout is engaged. Another embodiment of the present invention is to have a pouring spout that illuminates a portion of the liquid as it exits the container through the pouring spout when the container is moved or inverted and an automatic switch within the pouring spout is engaged. Another embodiment of the present invention is to have a pouring spout that simultaneously illuminates the liquid contained within the container, the container itself, and a portion of the liquid as it exits the container through the pouring spout when the container is moved or inverted and an automatic switch within the pouring spout is engaged.

Liquid Contact Electrical Switch Embodiments

Another embodiment of the present invention would be to have a pouring spout that illuminates any liquid in the container and the container itself when the illuminating device is engaged due to the electrical conductivity of the liquid completing an electrical circuit between a power source and a light source as the liquid contacts the pouring spout when liquid is being dispensed. Another embodiment of the present invention would be to have a pouring spout that illuminates a portion of the dispensed liquid when the illuminating device is engaged due to the movement or electrical conductivity of the liquid completing the circuit between a power source and a light source as the liquid contacts the pouring spout when liquid is being dispensed. Another embodiment of the present invention would be to have a pouring spout that simultaneously illuminates any liquid in the container, the container itself, and a portion of the dispensed liquid when the illuminating device is engaged due to the electrical conductivity of the liquid completing the circuit between a power source and a light source as the liquid contacts the pouring spout when liquid is being dispensed.

Illumination of the liquid in the container and the container itself can be achieved by positioning the light source near the receiving end of the pouring spout, aiming downward into the liquid container and through a transparent portion of the enclosed cavity. Illumination of a portion of the dispensed liquid can be achieved by positioning the light source near the dispensing end of the pouring apparatus, aiming outward from the pouring spout and through a transparent portion of the enclosed cavity. Illumination of a portion of the dispensed liquid can also be achieved by having a pouring spout with internal light-reflective walls so that the light source can be placed elsewhere within the pouring spout while achieving the same effect. Simultaneous illumination of the liquid container, any liquid in the container, and a portion of the dispensed liquid can be achieved by employing the method of illuminating the liquid in the container and container itself with either method of illuminating a portion of the dispensed liquid. Additionally, more than one power source and light source can be used to achieve sole or simultaneous illumination of the liquid container, any liquid in the container, and a portion of the dispensed liquid.

The present invention may be understood in greater detail by reference to the drawings along with the following description of the drawings and the detailed description of the invention.

BRIEF DESCRIPTION OF THE SEVERAL VIEWS OF THE DRAWINGS

The drawings represent the grasp-engaging electrical switch embodiment of the Illuminating Pouring Spout.

DETAILED DESCRIPTION OF THE INVENTION

Figure 1:
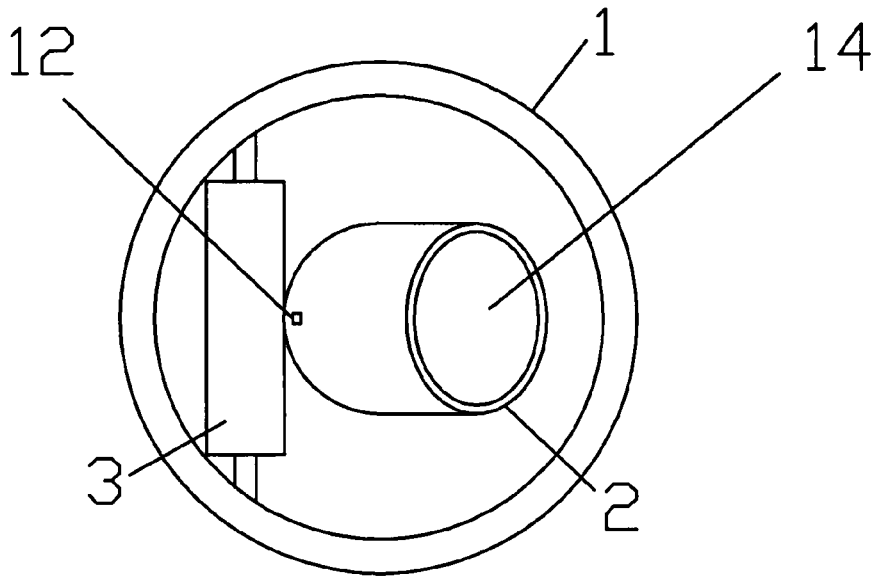
FIG. 1 is a top view of the dispensing end of one embodiment of the Illuminating Pouring Spout.
Figure 2:
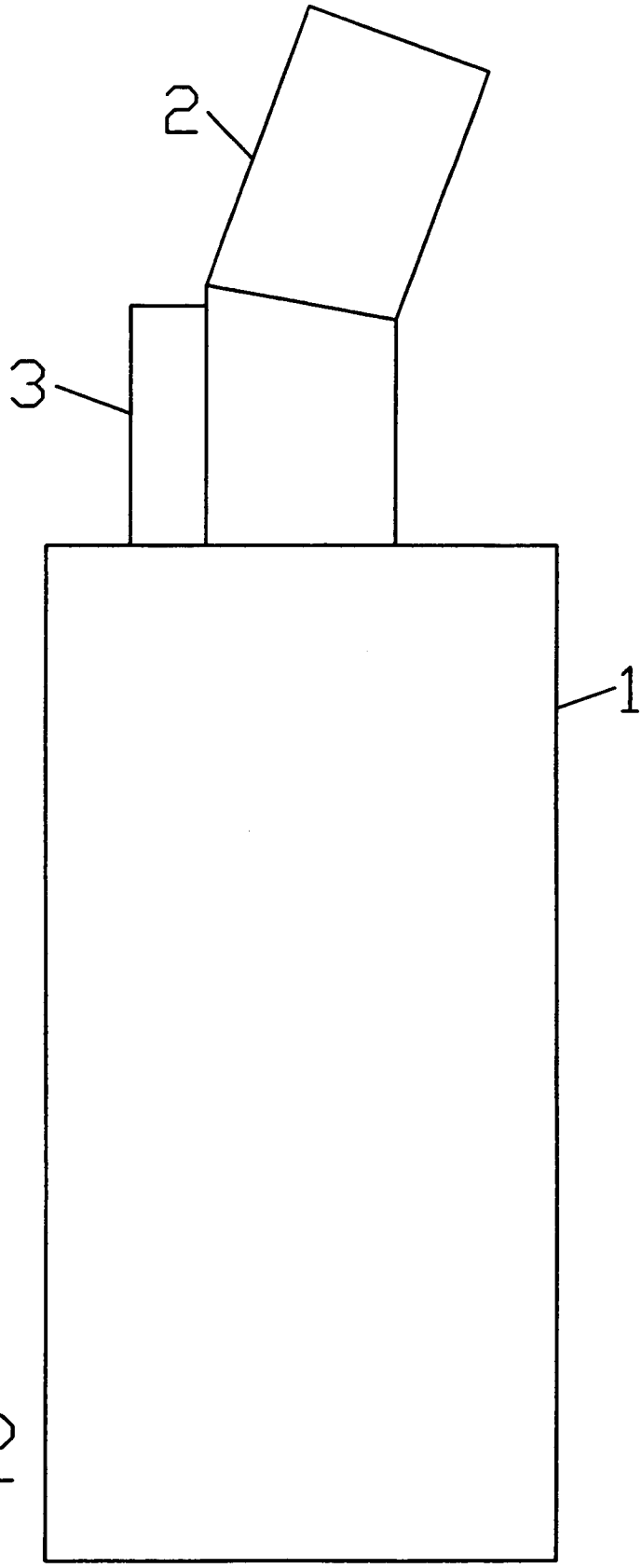
FIG. 2 is a side view of one embodiment of the Illuminating Pouring Spout.
Figure 3:
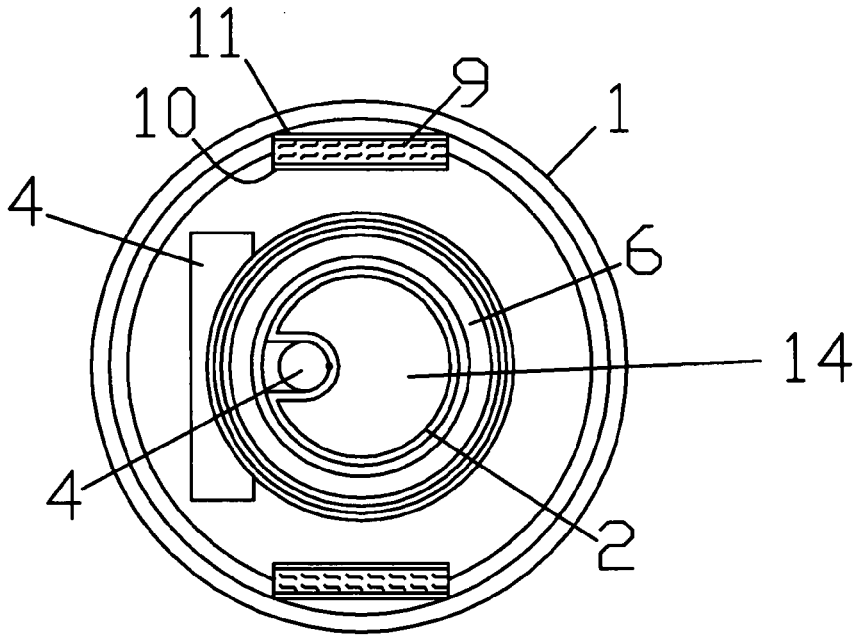
FIG. 3 is a top-sectional view of one embodiment of the Illuminating Pouring Spout.
Figure 4:
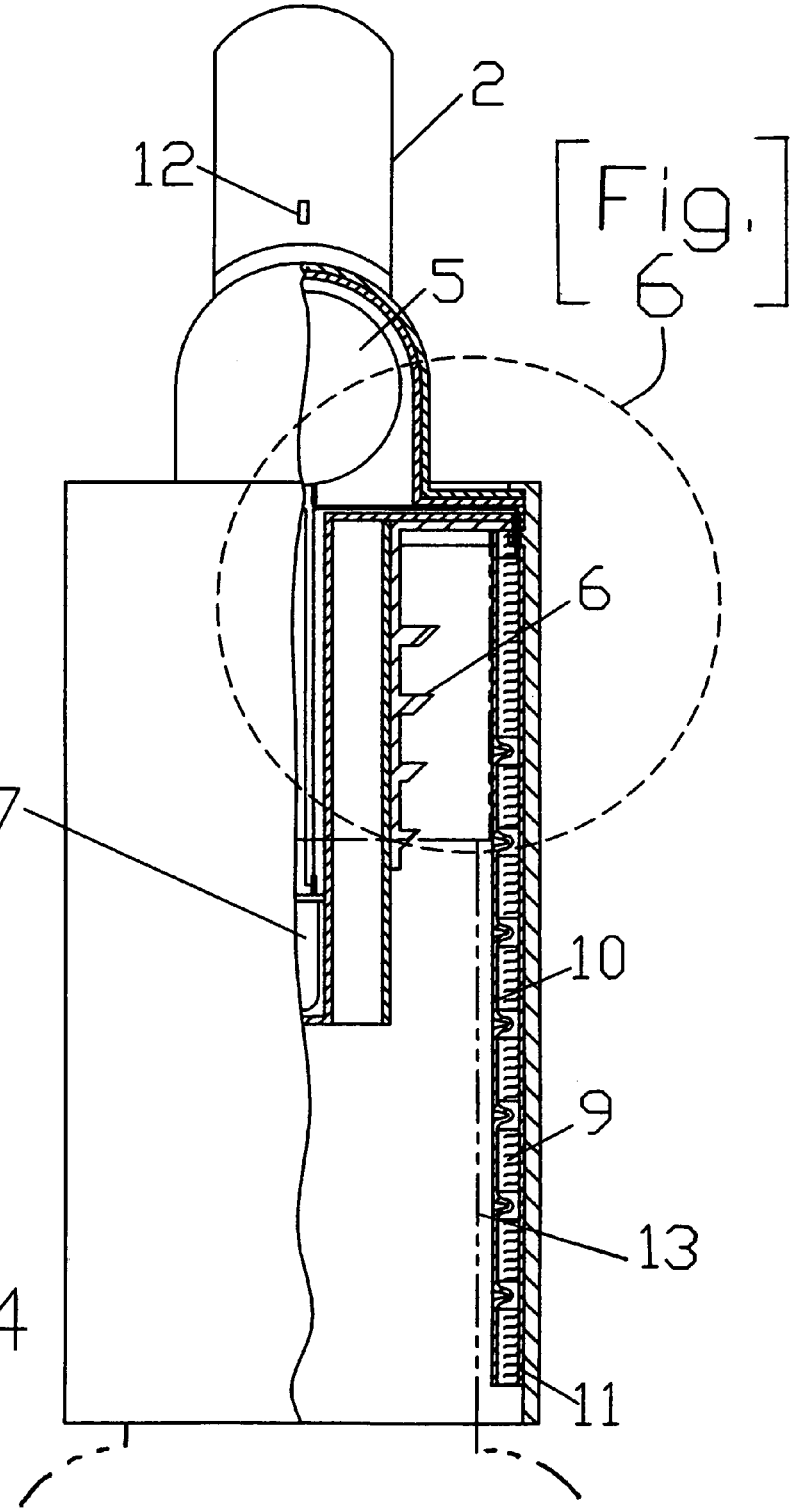
FIG. 4 is a partial cross-sectional view of the posterior end of one embodiment of the Illuminating Pouring Spout.
Figure 5:
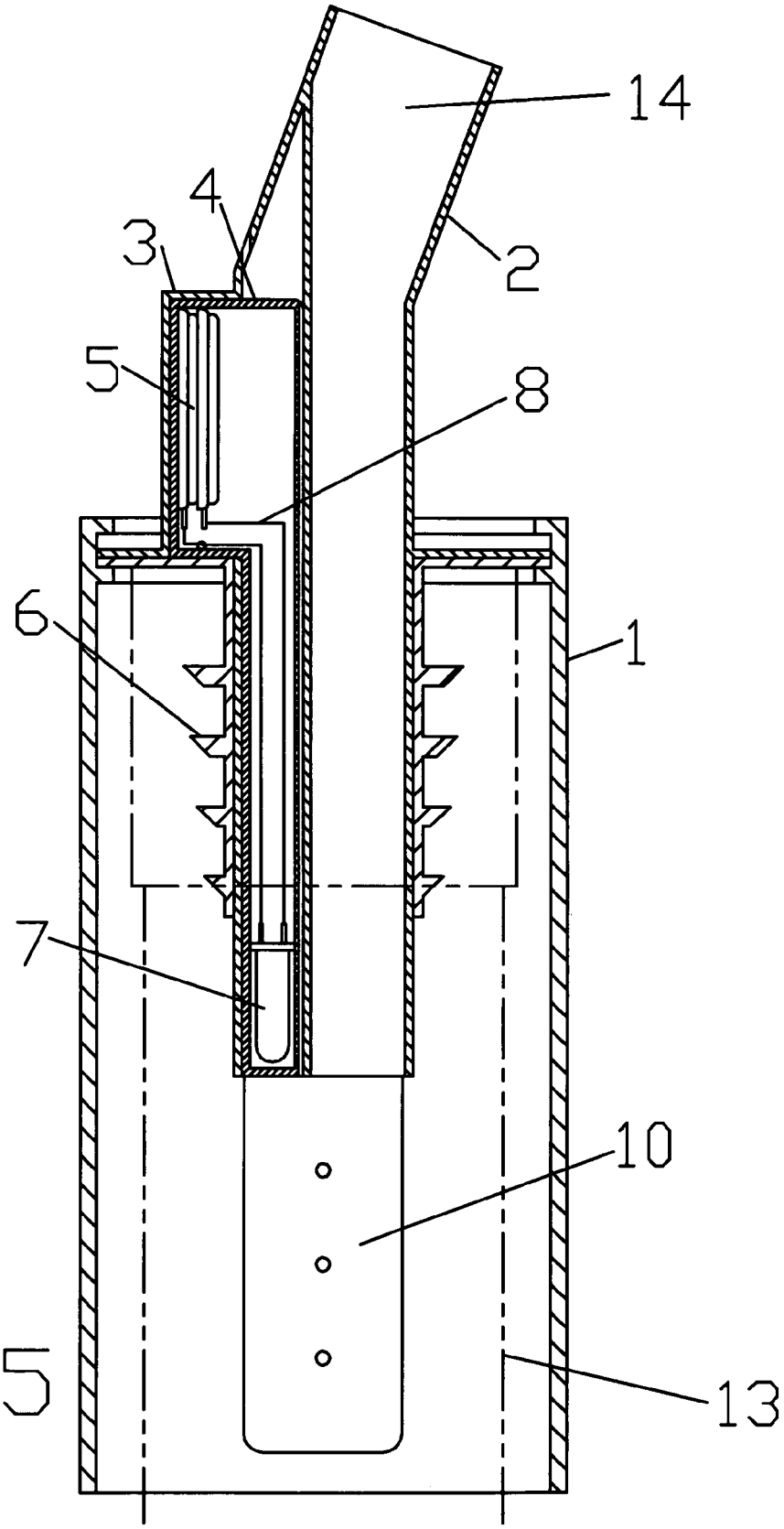
FIG. 5 is a full cross-sectional side view of one embodiment of the Illuminating Pouring Spout.
Figure 6:
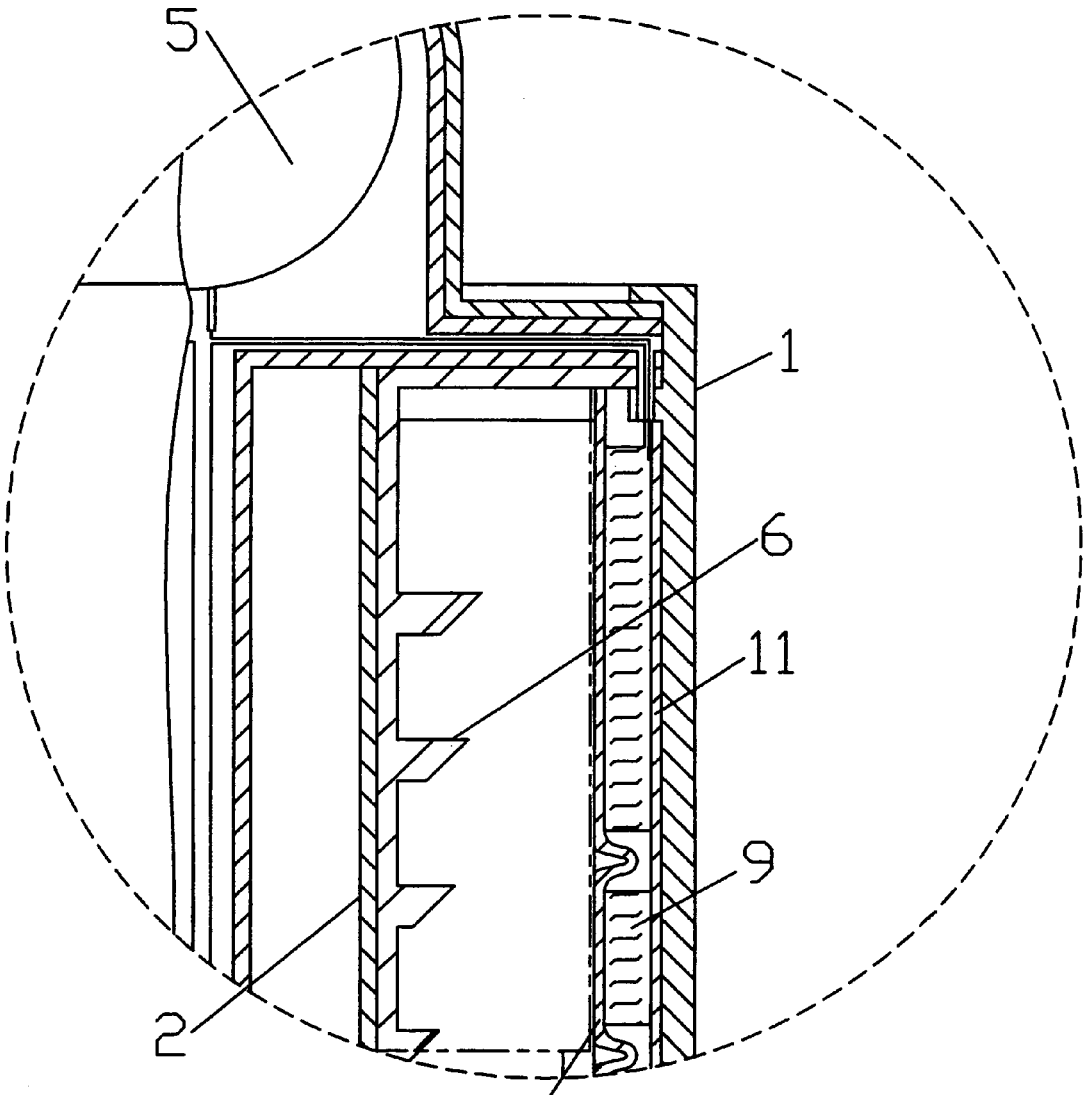
FIG. 6 is detail within the dotted circle of FIG. 4.

The drawings represent the grasp-engaging electrical switch embodiment of the Illuminating Pouring Spout. FIGS. 1 and 2 illustrate a dispensing end of the pouring spout from a top and side view respectively. Outer spout component 2 is a molded plastic polymer which contains power source cover 3 (a removable panel for replacing a spent power source) as part of outer spout component 2. Vent 12 is an opening located at the posterior end of outer spout component 2 and allows for more efficient liquid pouring through passage 14. Sleeve 1 surrounds the outer edge of open end of liquid container 13 and attaches thereto. FIG. 3 is a top-section of the grasp-engaging embodiment of the Illuminating Pouring Spout. Seal 6 is a ridged elastomer seal that bears elastically against the inner wall of open end of liquid container 13 to securely hold it in place. Seal 6, in conjunction with sleeve 1, creates a liquid-tight fit between the Illuminating Pouring Spout and open end of liquid container 13. Enclosed Cavity 4 is a sealed housing chamber within the pouring spout which contains a power source and a light source and serves to shield the power source and light source from liquid contact. One embodiment of the invention, as demonstrated in FIGS. 4 and 5, contains battery 5 and LED light 7 as its power source and light source respectively, to be connected via wire 8. The drawings represent one embodiment of the invention where the light source is aimed downward to illuminate any liquid in the container and the container itself. One embodiment of the invention, as shown in FIGS. 4, 5 and 6, has a switch mechanism that engages the illuminating device when open end of liquid container 13 is grasped. Non-conductive spring 9 is situated between outside switch contact 11 and inside switch contact 10 to form a low impact switch mechanism, which is situated along the exterior wall of open end of liquid container 13. When open end of liquid container 13 is grasped, or when slight pressure is applied, the circuit between outside switch contact 11 and inside switch contact 10 is completed to engage the Illuminating Pouring Spout.

The foregoing description is intended to serve as an example of the invention in one of its preferred embodiments and is not intended to limit the scope of the invention in any way.

We claim:

1. An illuminated pouring spout comprising: a passage through the pouring spout; at least one enclosed cavity within the pouring spout; at least one light source secured within said at least one cavity; at least one power source secured within said at least one cavity; and electrical switch mechanism connecting the power and light sources; and means for attaching said pouring spout to an open end of a liquid container; said electrical switch mechanism including an outside switch contact and an inside switch contact positioned on said means for attaching said illuminating pouring spout to said open end of said container; means for resiliently maintaining said inside and outside switch contacts in opened condition; said switch contacts being positioned adjacent an outer surface of said pouring spout, whereby upon the manual grasping of said pouring spout, said outer and inner switch contacts may be closed to illuminate said at least one light source.

* * * * *